United States Patent [19]

Hasker et al.

[11] Patent Number: 5,006,753

[45] Date of Patent: Apr. 9, 1991

[54] SCANDATE CATHODE EXHIBITING SCANDIUM SEGREGATION

[75] Inventors: Jan Hasker; Jacobus E. Crombeen; Anton K. Niessen; Henricus J. H. Stoffelen, all of Eindhoven, Netherlands

[73] Assignee: U.S. Philips Corporation, New York, N.Y.

[21] Appl. No.: 271,806

[22] Filed: Nov. 15, 1988

[30] Foreign Application Priority Data

Nov. 16, 1987 [NL] Netherlands ..... 8702727

[51] Int. Cl.[5] ..... H01J 19/14

[52] U.S. Cl. ..... 313/346 R; 252/521; 445/51

[58] Field of Search ..... 313/346 R, 346 DC; 252/521; 445/50, 51

[56] References Cited

U.S. PATENT DOCUMENTS

| | | | |
|---|---|---|---|
| 4,350,920 | 9/1982 | Bertens | 313/346 R |
| 4,518,890 | 5/1985 | Tagughi | 313/346 R |
| 4,626,470 | 12/1986 | Yamamoto et al. | 428/336 |
| 4,783,613 | 11/1988 | Yamamoto et al. | 252/521 |
| 4,855,637 | 8/1989 | Watanabe et al. | 313/346 R |

FOREIGN PATENT DOCUMENTS

| | | | |
|---|---|---|---|
| 91161 | 10/1983 | European Pat. Off. | 313/346 R |

*Primary Examiner*—Donald J. Yusko
*Assistant Examiner*—Michael Horabik
*Attorney, Agent, or Firm*—John C. Fox

[57] ABSTRACT

By providing at least the top layer of the matrix of a scandate cathode with an alloy or compound which exhibits scandium segregation, a satisfactory recovery for cathodes with a high emission can be achieved after ion bombardment.

17 Claims, 1 Drawing Sheet

SCANDATE CATHODE EXHIBITING SCANDIUM SEGREGATION

BACKGROUND OF THE INVENTION

The invention relates to a scandate cathode having a cathode body comprising a matrix of at least a high melting-point metal and/or alloy and a barium compound in contact with the matrix material which can supply barium to the emissive surface by chemical reaction with the matrix material.

The invention also relates to methods of manufacturing such a cathode and to an electron beam tube comprising such a cathode.

Cathodes of the type mentioned above are described in the article "Properties and Manufactured Top Layer Scandate Cathodes", Applied Surface Science 26 (1986), 173–195, J. Hasker, J. v. Esdonk and J. E. Crombeen. In the cathodes described in this article scandium oxide ($Sc_2O_3$) grains of several microns or tungsten (W) grains which are partially coated with either scandium (Sc) or scandium hydride (Sc $H_2$) are processed at least in the top layer of the cathode body. The cathode body is manufactured by pressing and sintering tungsten grains, whereafter the pores of the sintered body are impregnated with barium-calcium-aluminate. By chemical reaction with the tungsten of the matrix during operation of the cathode, the barium-calcium-aluminate supplies barium to the emissive surface in order to maintain the electron emission.

To be able to realize a very high cathode load after assembly in, for example, a cathode ray tube and activation of the cathode, it is important that a scandium-containing layer having a thickness of some monolayers has formed on the cathode surface during impregnation by reaction with the impregnant. To this end the impregnation process must be performed very carefully. As compared with the processing of an impregnated tungsten cathode, which may be coated with, for example osmium, this may be considered a drawback.

As has been proved by experiments described in the above-mentioned article, an ion bombardment which may occur in practice, for example during the manufacture of television tubes, may entirely or partly remove the scandium containing layer, with attendant detrimental results for emission. Since $Sc_2O_3$ is not very mobile (in the cathodes manufactured using W partially coated with Sc or Sc $H_2$ oxidation occurs during impregnation), the said scandium-containing layer cannot be fully regenerated by reactivating the cathode. As compared with an impregnated tungsten cathode, this may also be considered a drawback.

OBJECTS AND SUMMARY OF THE INVENTION

An object of the invention is to provide scandate cathodes which are improved with respect to the drawbacks mentioned.

The invention is based on the recognition that this can be achieved by using scandium-containing materials which due to the relatively low surface energy of scandium, segregate scandium to their surface upon heating. For example, at elevated temperature in vacuum a monolayer of scandium is deposited on the surface of certain compounds and alloys of scandium. After removal of this layer—by means of ion bombardment or another process—a new layer of scandium will be deposited on the surface at a sufficiently high temperature. This layer regeneration can of course be repeated until the scandium is depleted. The speed at which the scandium is dispensed to the emissive surface may depend on chemical reactions between the barium compound used and the source supplying scandium.

A scandate cathode according to the invention is characterized in that at least the top layer of the cathode body comprises a scandium compound or scandium alloy which can exhibit scandium segregation.

The compound or alloy preferably yields scandium at the operating temperature of the cathode, but this is not absolutely necessary. If the scandium is segregated at a higher temperature, this could occur first during cathode activation. Subsequently, the emission may decrease during operation due to evaporation and/or ion bombardment, but then it can be restored by reactivating the cathode at a sufficiently high temperature. The scandium may also segregate if the temperature becomes high enough during cathode manufacture (for example during impregnation).

Compounds and/or alloys of scandium comprising one or more of the metals rhenium (Re), ruthenium (Ru), hafnium (Hf), nickel (Ni), cobalt (Co), palladium (Pd), zirconium (Zr) or tungsten (W) were found to be satisfactory for use in cathodes of the invention.

Due to their high melting points and the fact that rhenium or ruthenium do not evaporate during operation and manufacture, $Re_{24}Sc_5$, $Re_2Sc$ and $Ru_2Sc$ are extremely suitable, particularly the rhenium compounds preferably in an amount of 5 to 50% by weight of the top layer of the cathode body, because they exhibit scandium segregation at the operating temperature of the cathode.

A first method of manufacturing a scandate cathode according to the invention is characterized in that a porous body comprising the scandium compound or scandium alloy at least in the top layer of the body is obtained by mixing, pressing and sintering powders of a high melting-point metal and/or alloy and a scandium compound or scandium alloy which can exhibit scandium segregation, whereafter said body is at least partly impregnated with a barium compound which can supply barium to the emissive surface by chemical reaction with the high melting point metal and/or alloy.

Another method is characterized in that the cathode body comprising the a scandium compound or scandium alloy in at least its top layer is obtained by mixing, pressing and sintering powders of a high melting-point metal and/or alloy and the scandium compound or scandium alloy combined with the powder of a barium compound which can supply barium to the emissive surface by chemical reaction with the high melting-point metal and/or alloy during operation of the cathode. In this method the sintering temperature is the highest temperature the cathode body ever acquires. This temperature may be substantially lower than the impregnation temperature which is generally used in the previous method. Consequently, the reaction of the barium compound with the scandium compound or scandium alloy is reduced which is advantageous in that a too vigorous reaction may give rise to a considerable scandium oxidation so that the supply of scandium is reduced.

BRIEF DESCRIPTION OF THE DRAWINGS

The invention will now be described in greater detail, by way of example, with reference to the accompanying drawing in which.

DESCRIPTION OF THE PREFERRED EMBODIMENTS

Figure 1:
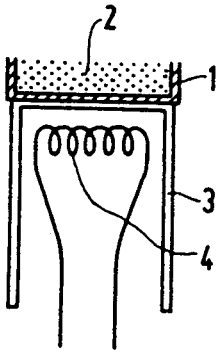
FIG. 1 shows diagrammatically an experimental set-up for testing scandium compounds and alloys.

FIG. 1 is a longitudinal sectional view of an experimental set-up for testing scandium compounds and alloys for segregation of scandium. A pulverulent scandium compound or scandium alloy 2 is pressed and sintered in the molybdenum tray 1. Subsequently, the tray 1 is welded onto the shaft 3 enclosing a heating element 4. The assembly is mounted in a Scanning Auger Microscope to measure the scandium concentration on the surface. This concentration can be reduced by means of ion bombardment and it may increase again after this bombardment due to scandium segregation. In this way various scandium compounds and scandium alloys have been tested, such as $Re_{24}Sc_5$, $Re_2Sc$, $Ru_2Sc$, $Co_2Sc$, $Pd_2Sc$, $Ni_2Sc$, $Sc_{50}Zr_{43}W_7$, $Sc_{68}Hf_{24}W_8$ and $Sc_{47}Hf_{41}W_{12}$.

Figure 2:
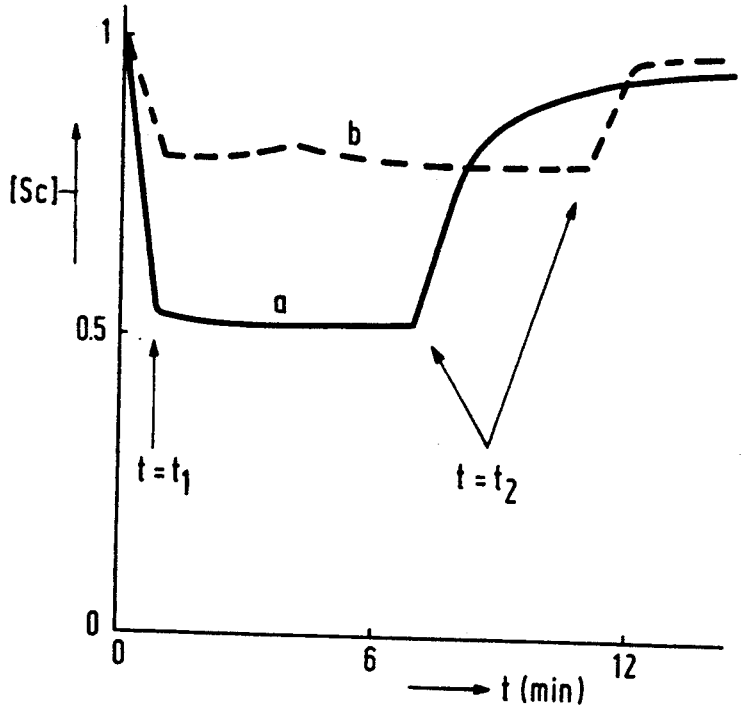
FIG. 2 shows graphically a result of segregation measurements on a scandium compound.

FIG. 2 shows a test result for the compound $Re_{24}Sc_5$, in which scandium concentration on the surface (normalized) is plotted versus time in minutes. Prior to the instant $t=0$ the experimental set-up had been at a set temperature for some time and this temperature was maintained during the measurement. At the instant $t=0$, approximately one monolayer of scandium was present on the surface, and the experimental set-up was exposed to an ion bombardment. Consequently, the scandium concentration on the surface decreased until at $t=t_1$ a balance was achieved between the supply and removal of scandium. The ion bombardment was switched off at $t=t_2$, and the original concentration was achieved again in a short time by scandium segregation. No scandium depletion was observed when the experiments were repeated several times. Curve a is for a set temperature of 950° C., the approximate cathode operating temperature. Curve b shows a similar result measured on the same experimental set-up at a temperature of 1100° C., the usual temperature for activating a scandate cathode. The balance during bombardment was achieved at a higher concentration than at 950° C. When the experiment was repeated for the compound $Ru_2Sc$, the compound did not exhibit any scandium segregation at either 950° or 1100° C.

Figure 3:
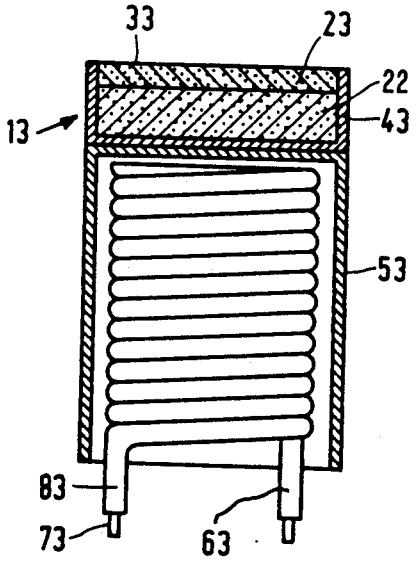
FIG. 3 is a diagrammatic representation of one embodiment of a cathode according to the invention.

FIG. 3 is a longitudinal sectional view of a scandate cathode according to the invention. The cathode body 13 has a top layer 23 and an emissive surface 33. This body, having a diameter of 1.8 mm, is obtained by pressing a matrix 22 of W powder with a top layer 23 on it comprising a mixture of W powder and a powder of a scandium compound or scandium alloy according to the invention. After pressing, a sintering operation is carried out at 1500° C. in a hydrogen atmosphere. The thickness of the matrix 22 is then approximately 0.5 mm and that of the top layer 23 is approximately 0.1 mm. The pressure during pressing of the cathode body is such that the increase in weight is substantially 4.5% after impregnation with $4BaO\text{-}1CaO\text{-}1Al_2O_3$ in a hydrogen atmosphere. The impregnated cathode body, optionally provided with an envelope 43, is cleaned in a known manner and welded onto the cathode shaft 53. A coiled cathode filament 63 which may consist of a helically wound metal core 73 with an aluminium oxide insulation layer 83 is present in the shaft 53.

EXAMPLES

Cathodes were manufactured in the manner described above with top layers consisting of W with 25 and 50% by weight of $Re_2Sc$ and with top layers consisting of W with 10 and 25% by weight of $Re_{24}Sc_5$. The emission of such cathodes, after assembly and activation, was measured in a diode arrangement with a cathode-anode gap of 0.3 mm at a 1000 Volt pulse load. In all cases the measured emission was substantially 100 $A/cm^2$ at an operating temperature of approximately 950° C.

In another example the top layer consisted of W with 10 and 25% by weight of $Ru_2Sc$. The emission was again substantially 100 $A/cm^2$ but, unlike the previous examples, it exhibited a decreased emission of approximately 30% after 8000 hours of a continuous load of 1.5 $A/cm^2$.

In yet another example, the top layer consisted of W with 5, 10 and 20% by weight of $Sc_{68}Hf_{24}W_8$. The measured emission varied between approximately 70 and 90 $A/cm^2$.

The above examples show that the high emissions characteristic of scandate cathodes can be realized by using scandium compounds or scandium alloys according to the invention.

Figure 4:
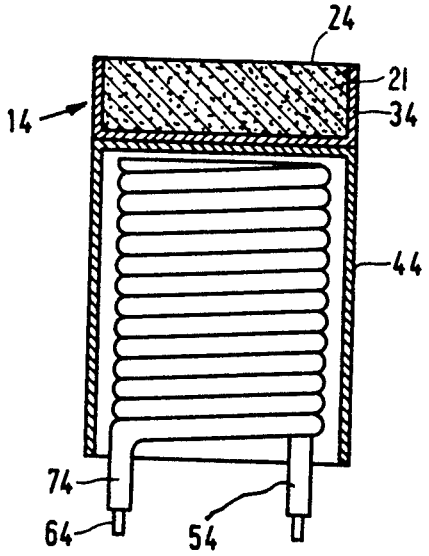
FIG. 4 is a diagrammatic representation of another embodiment of a cathode according to the invention.

FIG. 4 is a longitudinal sectional view of another scandate cathode according to the invention. The cathode body 14 has a matrix 21 with an emissive surface 24. This body, with a diameter of 1.8 mm and a thickness of approximately 0.5 mm is obtained by pressing a mixture of W powder and 10% by weight of $Re_{24}Sc_5$ powder and 7% by weight of barium-calcium-aluminate powder ($4BaO\text{-}1CaO\text{-}1Al_2O_3$) and by subsequently sintering at 1500° C. in a hydrogen atmosphere. The cathode body, optionally provided with a molybdenum envelope 34, is then welded onto the cathode shaft 44. The shaft 44 accommodates a coiled filament 54 which may consist of a helically wound metal core 64 having an aluminium oxide insulation layer 74. The measured emission after activation was approximately 100 $A/cm^2$ at a cathode temperature of 950° C. Auger measurements have proved that the scandium concentration on the surface is very low before activation. During activation, as described in the article mentioned in the opening paragraph, the scandium concentration required for the measured emission is formed on the surface. An advantage of this cathode is the simple method of its manufacture: impregnation and subsequent cleaning is not necessary.

The invention is of course not limited to the examples shown, but variations within the scope of the invention are possible to those skilled in the art. The emissive material may be present in a storage space under the actual matrix (L-cathode), while many design variations are also possible. Moreover, the barium supply to the emissive surface is not necessarily confined to the mechanism described herein but can also originate, for example from segregation from barium compounds or alloys because the surface energy of barium is lower than that of scandium.

What is claimed is:

1. A scandate cathode having a cathode body comprising a matrix of at least a high melting-point metal and/or alloy, and a barium compound in contact with the matrix material which barium compound can supply barium to the emissive surface by chemical reaction with the matrix material, characterized in that at least the top layer of the cathode body comprises a scandium metal compound or scandium alloy which can exhibit scandium segregation.

2. A scandate cathode as claimed in claim 1, in which the scandium metal compound or scandium alloy exhibits scandium segregation at the operating temperature of the cathode.

3. A scandate cathode as claimed in claim 1, in which the scandium metal compound or scandium alloy exhibits scandium segregation at an activation temperature which is higher than the operating temperature of the cathode.

4. A scandate cathode as claimed in claim 1, in which the scandium metal compound or scandium alloy exhibits scandium segregation at a temperature to which the cathode is subjected during one of its manufacturing steps.

5. A scandate cathode as claimed in claim 1, characterized in that the scandium metal compound or scandium alloy comprises one or more of the metals selected from the group consisting of rhenium (Re), hafnium (Hf), nickel (Ni), cobalt (Co), palladium (Pd), zirconium (Zr) or tungsten (W).

6. A scandate cathode as claimed in claim 5, in which the scandium metal compound or scandium alloy is selected from the group consisting of $Re_{24}Sc_5$, $Re_2Sc$, $Co_2Sc$, $Pd_2Sc$, $Ni_2Sc$, $Sc_{50}Zr_{43}W_7$, $Sc_{68}Hf_{24}W_8$ and $Sc_{47}Hf_{41}W_{12}$.

7. A scandate cathode as claimed in claim 6, in which the scandium metal compound is $Re_2Sc$ or $Re_{24}Sc_5$.

8. A scandate cathode as claimed in claim 7, in which at least the top layer of the cathode body comprises from 5 to 50% by weight of $Re_2Sc$ or $Re_{24}Sc_5$.

9. A scandate cathode as claimed in claim 1 in which the barium compound is provided in the cathode body by means of impregnation.

10. A scandate cathode as claimed in claim 1, in which matrix material, a barium compound and the scandium metal compound or scandium alloy are simultaneously pressed and subsequently sintered.

11. A method of manufacturing a scandate cathode, comprising mixing, pressing and sintering powders of a high melting-point metal and/or alloy and a scandium-containing material in at least its top layer, to form a porous body, and at least partly impregnating said body with a barium compound which can supply barium to the emissive surface by chemical reaction with the high melting-point metal and/or alloy, characterized in that the scandium containing material comprises a scandium metal compound or scandium alloy which can exhibit scandium segregation.

12. A method of manufacturing a scandate cathode, comprising mixing, pressing and sintering powders of a high melting-point metal and/or alloy and a scandium containing material in at least its top layer, and with the powder of a barium compound which can supply barium to the emissive surface by chemical reaction with the high melting-point metal and/or alloy during operation of the cathode, characterized in that the scandium-containing material comprises a scandium metal compound or scandium alloy which can exhibit scandium segregation.

13. A method as claimed in claim 11 or 12, in which the scandium metal compound or scandium alloy comprises one or more of the metals selected from the group consisting of rhenium (Re), hafnium (Hf), nickel (Ni), cobalt (Co), palladium (pd), zirconium (Zr) or tungsten (W).

14. A method as claimed in claim 13, in which the scandium metal compound or scandium alloy is selected from the group consisting of $Re_{24}Sc_5$, $Re_2Sc$, $Co_2Sc$, $Pd_2Sc$, $Ni_2Sc$, $Sc_{50}Zr_{43}W_7$, $Sc_{68}Hf_{24}W_8$ and $Sc_{47}Hf_{41}W_{12}$.

15. A method as claimed in claim 13, in which the scandium metal compound is $Re_2Sc$ or $Re_{24}Sc_5$.

16. A method as claimed in claim 15 in which at least the top layer of the cathode body comprises 5 to 50% by weight of $Re_2Sc$ or $Re_{24}Sc_5$.

17. An electron beam tube is provided for said scandium cathode as claimed in claim 1.

* * * * *